US006047852A

United States Patent [19]

Evans et al.

[11] Patent Number: 6,047,852

[45] Date of Patent: Apr. 11, 2000

[54] HOT BEVERAGE LID WITH THERMAL FLEX-GUARDS

[75] Inventors: Michael G. Evans, Cincinnati, Ohio; Johnny B. Strunk, Walton; John K. Bruce, Florence, both of Ky.

[73] Assignee: Waddington North America, Inc., Chelmsford, Mass.

[21] Appl. No.: 09/183,755

[22] Filed: Oct. 30, 1998

Related U.S. Application Data

[63] Continuation-in-part of application No. 08/964,495, Nov. 5, 1997, abandoned.

[51] Int. Cl.[7] ..... B65D 41/26; A47G 19/22

[52] U.S. Cl. ..... 220/793; 220/710.5; 220/713; 220/737; 229/403; 229/404

[58] Field of Search ..... 220/780, 784, 220/793, 796, 805, 212, 212.5, 703, 710.5, 711, 713–717, 730, 737–740, 752, 753, 755, 756, 759, 768, 769, 772, 903, 918, 921, 592.17, 592.2, 592.24, 592.23, 592.25, 324, 326, 786, 788; 222/183, 131, 475.1; 229/403, 404, 400, 906.1

[56] References Cited

U.S. PATENT DOCUMENTS

| | | | |
|---|---|---|---|
| 236,266 | 1/1881 | Shirley . | |
| 622,564 | 4/1899 | Tebbetts . | |
| 1,034,636 | 8/1912 | McNair . | |
| 1,441,010 | 1/1923 | McGuire . | |
| 1,629,358 | 5/1927 | Padgett . | |
| 2,259,856 | 10/1941 | Moore . | |
| 3,101,857 | 8/1963 | Freedman . | |
| 4,190,173 | 2/1980 | Mason . | |
| 4,494,672 | 1/1985 | Pearson . | |
| 4,589,569 | 5/1986 | Clements . | |
| 4,899,902 | 2/1990 | DeMars | 220/703 |
| 5,054,640 | 10/1991 | Tucker . | |
| 5,125,525 | 6/1992 | Tucker . | |
| 5,203,467 | 4/1993 | Tucker . | |
| 5,205,473 | 4/1993 | Coffin, Sr. . | |
| 5,222,656 | 6/1993 | Carlson . | |
| 5,240,132 | 8/1993 | Tucker . | |
| 5,253,780 | 10/1993 | Adado . | |
| 5,253,781 | 10/1993 | Van Melle et al. | 220/713 |
| 5,348,181 | 9/1994 | Smith et al. . | |
| 5,398,843 | 3/1995 | Warden . | |
| 5,425,497 | 6/1995 | Sorensen . | |
| 5,538,157 | 7/1996 | Proshan | 220/713 X |
| 5,579,949 | 12/1996 | Dykes et al. . | |
| 5,613,720 | 3/1997 | Shaddy | 220/739 X |
| 5,624,053 | 4/1997 | Freek et al. | 220/713 |
| 5,765,716 | 6/1998 | Cai et al. . | |
| 5,772,111 | 6/1998 | Kirsch | 229/403 |
| 5,820,016 | 10/1998 | Stropkay | 229/403 |
| 5,839,601 | 11/1998 | Van Melle | 220/717 X |
| 5,894,952 | 4/1999 | Mendenhall et al. | 220/717 X |

*Primary Examiner*—Nathan J. Newhouse
*Attorney, Agent, or Firm*—Pearson & Pearson

[57] ABSTRACT

A hot beverage lid having thermal protective flex-guards or flaps extending from opposite sides of a cover portion of the lid for protecting a consumer's fingers from heat emanating from the side of a cup. A first flap extends a first distance from under a drinking opening having sufficient area for a thumb. A second flap extends a second distance which is greater than the first flap from the opposite side of the lid and has sufficient area for at least two fingers. Each flap is contoured to conform to the curvature or the sidewall of the cup and each flap comprises swirled rib embossing for improved retention against fingers holding the cup. The top of the cover portion is concave with a hole in the center to allow liquid spillage to reenter the cup. Also, a channel surrounding the base of a circular plateau on top of the cover of the lid is provided for collecting fluid spillage.

42 Claims, 9 Drawing Sheets

HOT BEVERAGE LID WITH THERMAL FLEX-GUARDS

CROSS REFERENCE TO RELATED APPLICATION

This is a continuation-in-part of application Ser. No. 08/964,495, filed Nov. 5, 1997, now abandoned, and assigned to the same assignee as the parent application.

BACKGROUND OF THE INVENTION

1. Field of the Invention

The present invention relates generally to cups with lids for hot drinks, and more particularly to a cup lid having means for protecting the fingers of a person holding the cup from the heat of the cup contents.

2. Description of Related Art

Most beverage containers are made from paper materials that provide little resistance to thermal conductivity of the temperature of a hot or a cold beverage held in the container. These beverage containers provide an acceptable degree of thermal insulation when a beverage is warm, but when the beverage temperature is at or near the boiling point, such cups do not have sufficient insulation to protect a drink holder's hand or fingers. A large amount of heat is conducted from the beverage through the sidewall of the container making it impossible for the person to safely and comfortably hold the container. Often the person drinking from a hot cup puts the hot cup inside an empty cup to obtain sufficient insulation from the heat. However, the cup cost then doubles.

Another solution to the hot beverage container problem is described in U.S. Pat. No. 5,425,497 issued Jun. 20, 1995 to Jay Sorenson which discloses a cup holder in the form of a sheet with distal ends. A web is formed in one of the ends, and a corresponding slot is formed in the other end such that the ends interlock. Hence, the cup holder is assembled by rolling the sheet and interlocking the ends. The sheet can be an elongated band of pressed material, preferably pressed paper pulp and preferably formed with multiple nubbins and depressions. However, this is a separate piece in addition to the cup and lid requiring extra cost to purchase and time to assemble by interlocking the ends.

U.S. Pat. No. 4,190,173 issued Feb. 26, 1980 to Leroy W. Mason and Frederick J. Furner and assigned to Flambeau Products Corporation describes a beverage container having a doubled-walled construction. The double-walled construction may be made by mounting an inner container inside an overly large outer container with a seal between the inner and outer containers. However, this seal can release which partially destroys the thermal integrity of the container. If the liquid is extremely hot, such as at or near the boiling point, this type of cup will eventually conduct most of the heat to the outer wall.

U.S. Pat. No. 5,348,181, issued Feb. 26, 1980 to Bruce R. Smith and Reinhold Gerber and assigned to James River Corporation of Virginia, describes a drinking cup lid having tabs extending from opposite sides of the lid. The tabs are molded to have a slight curvature so that in the extended position, an outer surface is concave while an inner surface is convex. This concavo-convex design biases tabs in the extended position. As the tabs are pushed into the retaining position, the concavo-convex tab design combined with the curvature of the hinge forces the tabs to flex or buckle causing outer surface into a convex shape and inner surface into a concave shape whereby the gripping portion conforms generally to the curvature of sidewall. Simultaneously, the tabs are biased inwardly toward the cup sidewall. This biasing feature also forces a latching lip against the rim of the cup, thereby effectively securing the lid on the cup while maintaining an effective seal between a skirt of the lid receiving channel and the rim of the cup. However, the tabs structure and lid top structure are not conducive to low cost production. Such a locking lid is difficult to remove to add sugar or milk, and spillage can easily occur when trying to remove the locking lid. In addition, the tabs have minimal surface area for finger protection.

SUMMARY OF THE INVENTION

Accordingly, it is therefore an object of this invention to provide a lid for a hot beverage container having a thermal flex-guard for protecting a consumer's fingers from heat emanating from the side of the container.

It is another object of this invention to provide a hot beverage container lid having downward extending, plastic guards on opposite sides of the lid for providing thermal protection.

It is yet another object of the invention to provide a lid having tabs on opposite sides of the lid, and when the lid is positioned on the cup, the tabs are folded downward adjacent to the side of the cup to provide thermal protection to a cup holder's fingers.

It is yet another object of the invention to provide a lid having flaps on opposite sides of a cover portion, and when the lid is engaged on the cup, the flaps are easily folded downward adjacent to the side of the cup to provide sufficient thermal protection to a cup holder's fingers, thereby avoiding material waste by the cup holder using double cups.

It is still another object of this invention to provide a hot beverage lid having flaps extending from opposite sides for providing thermal protection wherein the flaps provide an indication of the drinking opening location when in a dark environment, by being of different lengths.

It is yet another object of this invention to provide an improved lid which prevents spillage by having a concave top surface with a center hole for returning a spilled liquid within a cup.

It is a further object of this invention to provide a drinking cup lid having flaps extending from opposite sides of a cover portion and a channel around the periphery of an upper portion of the cover for collecting liquid spillage.

It is another object of this invention to provide a hot beverage lid having flaps with swirled ribs extending from opposite sides of the lid for providing thermal protection and for improved retention when grasped by fingers of a cup holder.

The objects are further accomplished by a lid for covering a drinking cup, and guard means extending downward from the periphery of the lid for providing thermal protection to fingers of a cup holder. The guard means comprises at least one thermal protector extending downward from the lid a predetermined distance, the thermal protector extending from a predetermined position on the periphery of the lid. The guard means comprises a plastic means for allowing air between the guard means and a hot surface of the drinking cup. The plastic means comprises an irregular surface. The lid comprises a top wall having a circular periphery, mounting means at the bottom of the lid for sealingly engaging an upper rim of the cup, and an opening in the lid adjacent to the periphery to enable drinking from the cup without removal of the lid.

The objects are further accomplished by a lid for sealingly engaging an upper rim of a drinking cup, means extending from opposite sides of the lid a predetermined distance away from the lid, the extending means including means for enabling the extending means to be folded downward toward a side of the cup. The extending means comprises a plastic means for allowing air between the folded downward extending means and a hot surface of the drinking cup. The plastic means comprises an embossed surface. The enabling means of the extending means comprises a flexible hinge means attached to a portion of the periphery of the lid.

The objects are further accomplished by a method of providing a lid having thermal protection for a drinking cup comprising the step of providing guard means extending downward a predetermined distance from the lid to thermally protect the fingers of a cup holder. The step of providing guard means comprises the step of the guard means comprising a formed plastic means for allowing air between the guard means and a hot surface of the drinking cup.

The objects are further accomplished by a lid comprising a cover for sealingly engaging an upper rim of a drinking cup, the cover comprises a circular plateau having a raised portion with a drinking opening, means for thermal protection of fingers of a cup holder, the thermal protection means extending from portions of opposite sides of the cover of the lid, means positioned between the cover and the thermal protection means for folding down the thermal protection means to be positioned adjacent to a sidewall of the cup, and the thermal protection means comprises a contour conforming to a sidewall of the cup. A first one of the thermal protection means adjacent to the drinking opening is shorter than a second one of the thermal protection means on the opposite side of the cover. The folding down means comprises a strip of compressed material. The raised portion of the circular plateau having the drinking opening on a top surface is positioned above one of the thermal protection means when the thermal protection means are folded down. The thermal protection means comprises a plurality of standoffs extending from a surface closest to the sidewall for contact with the sidewall of the cup. The cover comprises a moat channel around a periphery of an upper portion of the cover for collecting liquid spillage. A top concave surface surrounded by the circular plateau of the cover comprises a in the center for returning liquid spillage to the cup. The thermal protection means comprises embossing for facilitating cup retention when grasped by fingers of the cup holder. The embossing comprises vertically oriented swirled ribs The objects are further accomplished by a lid for a drinking cup comprising a cover for sealingly engaging and disengaging an upper rim of the drinking cup, a drinking opening positioned on a raised portion of a circular plateau on top of the cover, a first flap extending a first distance from a first portion of the cover adjacent to the drinking opening for providing thermal protection, a second flap extending a predetermined second distance from an opposite portion of the cover for providing thermal protection, first flexible hinge means between the first flap and the first portion of the cover and second flexible hinge means between the second flap and the opposite portion of the cover for enabling the first flap and the second flap to be folded down and remain down adjacent to a sidewall of the drinking cup. Each of the first flap and the second flap comprises a contour conforming to the sidewall of the cup. Each of the first flap and the second flap comprises an embossing to provide increased cup retention when grasped by fingers of a cup holder. The embossing comprises vertically oriented swirled ribs. Each of the first flap and the second comprises embossing including swirled ribs to provide thermal protection to a cup holder's fingers. Each of the first flap and the second flap comprises a plurality of standoffs extending from the surface of the first flap and the second flap closest to the sidewall to provide the thermal protection to a cup holder's fingers. Each of the first flexible hinge and the second flexible hinge comprises a strip of compressed material for enabling the first flap and the second flap to remain folded down adjacent to the sidewall of the drinking cup. The lid comprises a high impact polystyrene plastic. The lid comprises a polypropylene plastic. The lid comprises a formation of the cover in a direction above the cover and the first flap and the second flap comprises a formation of the plurality of standoffs in a direction under the first flap and the second flap. The circular plateau comprises a recessed area along a side of the plateau opposite the drinking opening for accommodating a finger of a cup holder. The circular plateau encircles a concave top portion of the cover having a hole in the center thereby allowing liquid spillage to reenter the cup. The cover comprises a moat channel formed between a side wall of the circular plateau and an outer surface of a channel for sealingly engaging an upper rim of the drinking cup, the moat channel collecting liquid spillage. The concave top portion of the cover, surrounded by the circular plateau, comprises a diameter sufficient to receive a bottom portion of a drinking cup, thereby facilitating stacking of cups. The lid enables a cup holder to identify a side of the cover having the drinking opening by means of a shorter length of the first flap positioned under the drinking opening when the lid is engaged to the cup. Each of the first flap and the second flap comprises a depression along outer side edges for providing comfortable and secure placement of a person's fingers.

The objects are further accomplished by a method of providing a lid for a drinking cup comprising the steps of providing a cover for sealingly engaging an upper rim of the drinking cup, providing on the cover a circular plateau having a raised portion with a drinking opening, protecting fingers of a cup holder with thermal protecting means extending from portions of opposite sides of the cover of the lid, folding down the thermal protecting means to be positioned adjacent to a sidewall of the cup with means positioned between the cover and the thermal protecting means, and providing the thermal protecting means with a contour conforming to a sidewall of the cup. The method comprises the step of providing a first one of the thermal protecting means adjacent to the drinking opening to be shorter than a second one of the thermal protecting means on an opposite side of the cover. The step of folding down the thermal protecting means comprises the step of providing a strip of compressed material between the cover and the thermal protecting means. The method comprises the step of providing a raised portion of the circular plateau having a drinking opening on a top portion of the raised portion above a shorter one of the thermal protecting means when the thermal protecting means are folded down. The step of providing thermal protecting means comprises the step of providing a plurality of standoffs extending from a surface of the thermal protecting means closest to the sidewall for contact with the sidewall of the cup. The method comprises the step of providing a moat channel around a periphery of an upper portion of the cover for collecting liquid spillage. The method comprises the step of providing a top concave surface surrounded by the circular plateau of the cover with a hole in the center for returning liquid spillage to the cup. The method comprises the step of providing the thermal protecting means with embossing for facilitating cup retention when grasped by fingers of the cup holder. The step of embossing the thermal protecting means comprises the step of providing vertically oriented swirled ribs.

Additional objects, features and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

FIG. 7 is a plan view of the lid disposed on the cup of

DESCRIPTION OF ILLUSTRATIVE EMBODIMENTS

Figure 1:
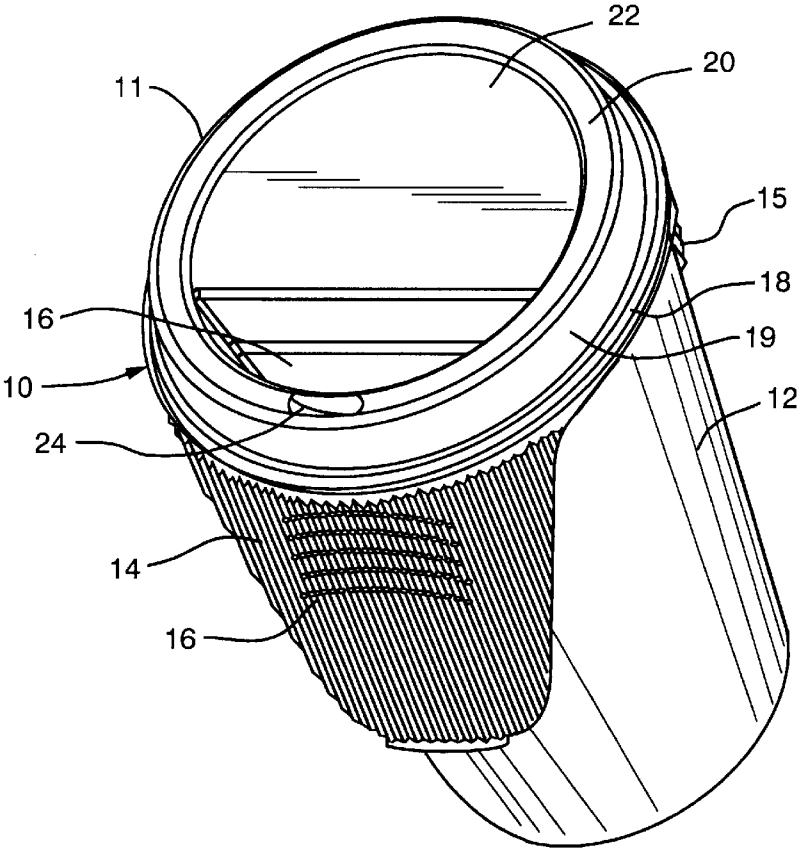
FIG. 1 is a perspective view of the invention showing a lid disposed on a beverage cup having downward extending protective guards on opposite sides of the cup.

Referring to FIG. 1, a perspective view of a first embodiment of the invention is shown comprising a formed plastic lid 10, disposed on a conventional beverage cup 12. The lid 10 comprises an upper portion cover 11 and lower portion thermal guard(s) 14, 15. The upper portion cover 11 of the lid 10 comprises a mounting portion 18 for engaging the lip of the cup 12, a top wall 22 and a drinking opening 24 formed on an outer portion 20 of the top wall 22. The top wall 22 of the lid 10 has a recess 16 formed in it adjacent to the drinking opening 24 to accommodate the upper lip of the user. Other commonly known lid designs are likewise suitable for implementing the upper cover 11 portion of lid 10.

The lower portion of lid 10 comprises downwardly extending plastic guard(s) 14, 15 for protecting a cup holder's fingers from heat generated by a hot beverage in the cup 12. The cup 12 is of a paper construction, commonly known to one of ordinary skill in the art, having a tapering cylindrical configuration. At the upper periphery of cup 12 is a circular lip typically rolled over to form a bead. The actual construction of the cup 12 may vary substantially and include in addition to paper cups having rolled rim beads, styrofoam, and plastic cups having unbeaded lips. Such cups are commonly used as carry-out containers for beverages such as coffee and the like.

Figure 2:
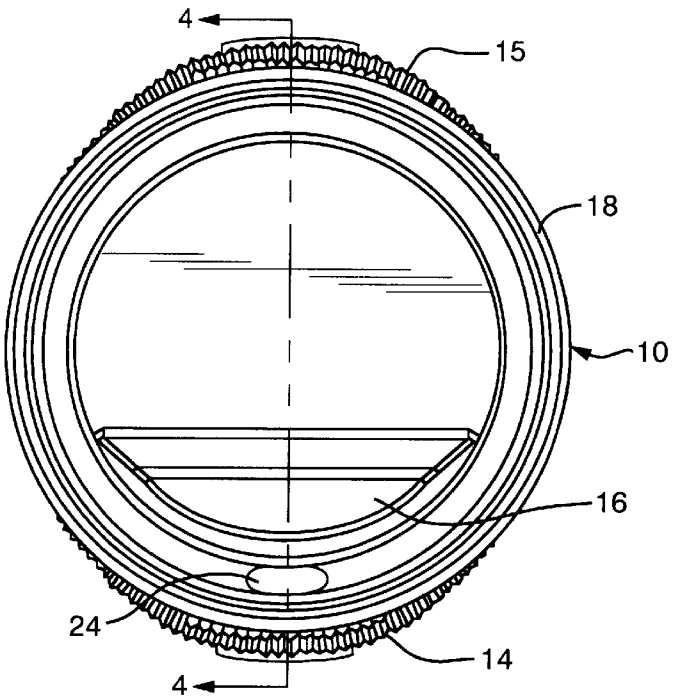
FIG. 2 is a plan view of the lid disposed on the cup of FIG. 1.
Figure 3:
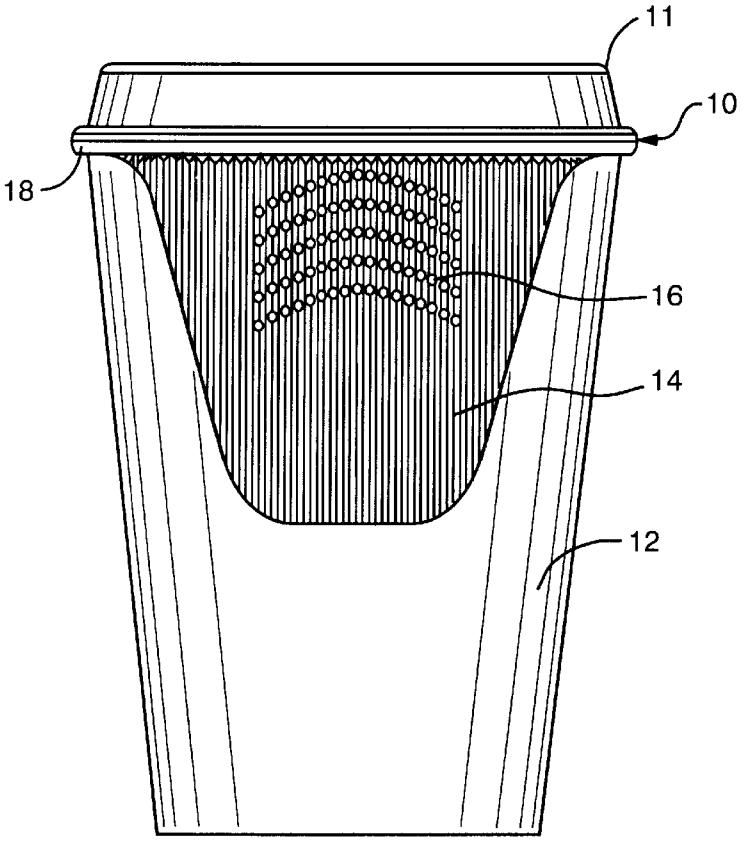
FIG. 3 is a side elevated view of the lid and beverage cup of FIG. 1 showing the protective guard having a roughened area for gripping the guard.

Referring to FIG. 2 and FIG. 3, FIG. 2 is a plan view of the lid 10 and FIG. 3 is a side, elevated view of the lid 10 disposed on beverage cup 12 showing protective guard 14 extending downward from the cover 11 portion. For convenience of description, terms such as "upward", "downward", "horizontal", "vertical", etc., are used herein referring to the lid 10 in an orientation as illustrated in FIG. 3. However, during use the lid 10 normally assumes various different orientations.

The guards 14, 15 extend from the lower edge periphery of the mounting portion 18 of the cover 11. They are made of formed corrugated plastic having a structure of ridges and valleys running vertically as shown in FIG. 3. However, other designs are equally applicable to achieve thermal protection by providing air between a hot surface of the cup 12 and the fingers of the cup holder, such as an embossed or sculptured design for the guards 14, 15. Protective guard 14 extends downwardly a predetermined distance sufficient to provide thermal protection under the drinking opening 24.

Figure 4:
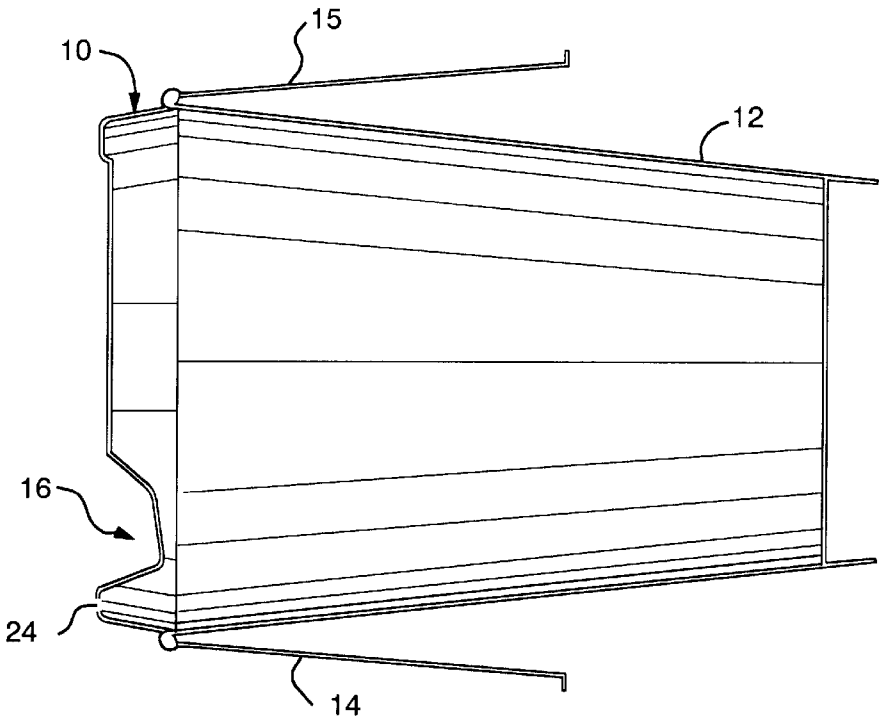
FIG. 4 is a cross-sectional view along line 4—4 of FIG. 2.

Referring now to FIG. 4, a cross-sectional view of the lid 10 disposed on cup 12 along line 4—4 in FIG. 2 shows two protective guards 14, 15 on opposite sides of the lid 10. The second guard 15 having the same dimensions as guard 14 extends downwardly from the lower edge periphery of the mounting portion 18 of cover 11 on the opposite side from guard 14 of the lid 10. Other designs for a thermal guard extending downwardly from the cover 11 portion of the lid 10 may be implemented for protecting the holder's fingers from the heat of a hot beverage in cup 12. For example, instead of having two guards 14, 15 on opposite sides of the lid 10, one guard may be used for thermal protection of the hand when grasping the cup 12, and it may be formed by simply continuing the guard 14 to meet guard 15 around one of the former unguarded sides of the lid 10. One will readily recognize that there are many variations to the length and width of the downward extending guard(s) 14, 15 of the lid 10 for providing thermal protection.

Figure 6:
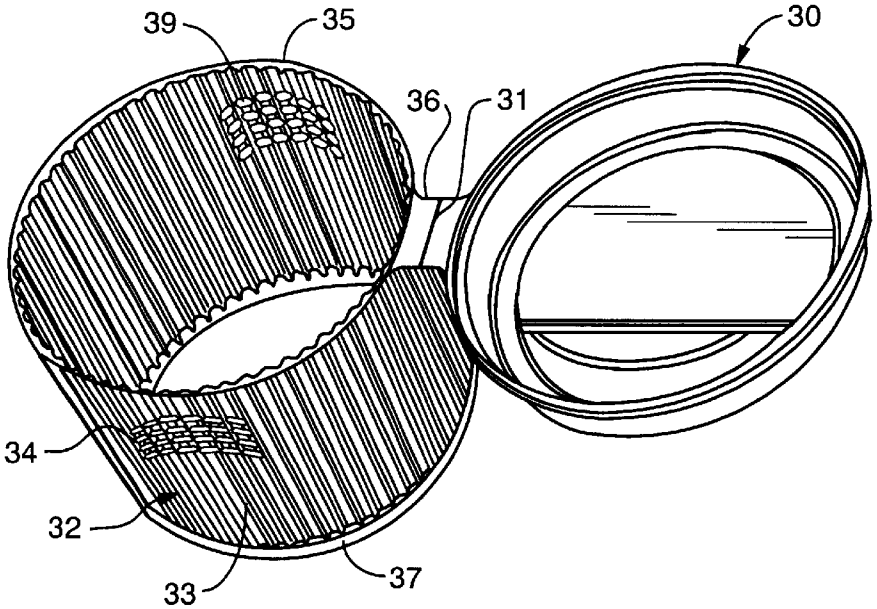
FIG. 6 is a perspective view of the combination of the lid and protective guard connected together via a hinge.
Figure 5:
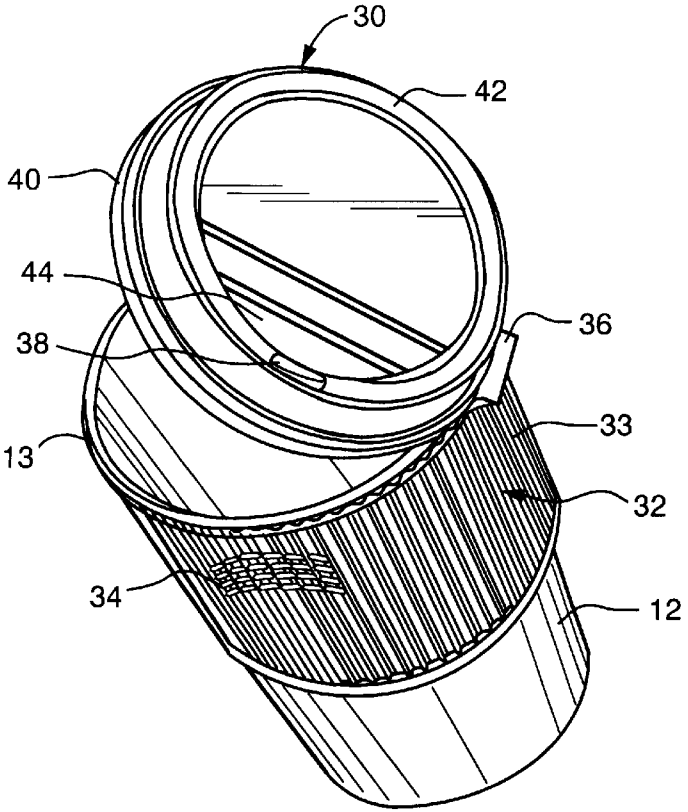
FIG. 5 is a perspective view of an alternate embodiment of the invention showing a lid hinged to a protective guard which surrounds the upper portion of a cup.

Referring now to FIG. 5 and FIG. 6, FIG. 5 shows a perspective view of the second embodiment of the invention for protecting the hand of the user from a hot beverage cup 12. FIG. 6 shows a perspective view of the combination of lid 30 and protective guard 32 connected together by a hinge 36 thereby providing 360 degrees of thermal protection around the cup 12. The bottom of cup 12 is easily inserted through the hollow, tapering cylindrical guard 32. The guard 32 fits around the upper portion of cup 12 with the upper periphery 35 of guard 32 resting against the circular lip 13 of cup 12.

A cylindrical wall 33 of the guard 32 may be made of formed plastic having a corrugated structure with ridges and valleys running in a vertical direction between the upper periphery 36 and the lower periphery 37 as shown in FIGS. 5 and 6. Other non-corrugated wall designs such as embossing or sculpturing or other irregular designs are equally applicable. Roughened surfaces 34, 39 on the cylindrical wall 33 may be positioned on opposite sides of such wall 33 and centered ninety degrees from the hinge 36 although they are not necessary. The roughened surfaces 34, 39 provide for a better grip when grasping the guard 32 to drink from the drinking opening 38 on the top of the lid 30.

Still referring to FIG. 5 and FIG. 6, the hinge 36, which connects the lid 30 to the protective guard 32, allows the lid 30 to easily rotate for positioning on and covering the top of the cup 12. As shown in FIG. 6, the hinge 36 has an indentation line 31 across the width of the hinge 36 to enable the hinge to bend at this point as the lid is rotated on top of a cup 12 as shown in FIG. 5.

Figure 11A:
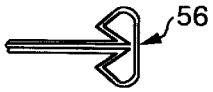
FIG. 11A is a side elevational view of an alternate hinge for connecting a lid to a protective thermal guard, when the hinge is closed.
Figure 11B:
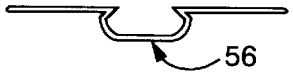
FIG. 11B is a side elevational view of the alternate hinge of FIG. 11A when the lid and hinge are opened approximately 180 degrees from the closed position.

Referring now to FIG. 11A and FIG. 11B, an alternate embodiment of a hinge 56 is shown. FIG. 11A shows a side elevational view of a channel type hinge 56 when the hinge 56 is closed for connecting the lid 30 to the protective guard 32. FIG. 11B shows a side elevational view of the channel type hinge 56 when the hinge 56 is opened approximately 180 degrees from the closed position. Other hinge designs known in the art are also applicable to this invention.

Figure 8:
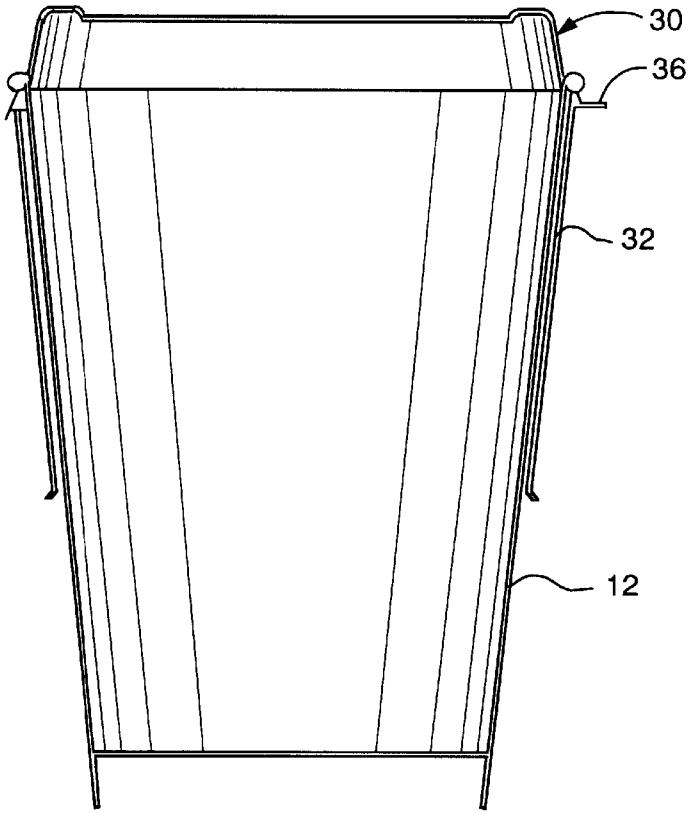
FIG. 8 is a cross-sectional view along line 8—8 of FIG. 7.
Figure 7:
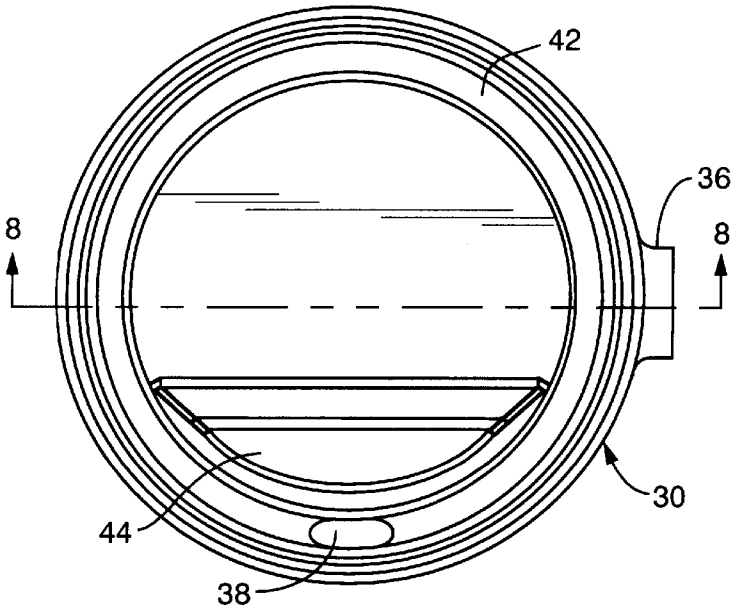

Referring now to FIG. 7 and FIG. 8, FIG. 7 is a plan view of the lid 30 showing the drinking opening 38, the recess 44 and the hinge 36 in the closed position. The construction of the lid 32 is the same as cover 11 of FIG. 1. Referring to FIG. 8, a cross-sectional view of the lid 30 disposed on the top of cup 12 along lines 8—8 of FIG. 7 shows the tapering shape of guard 32 hugging the side of the cup 12. However, a non-tapering guard 32 is equally applicable.

Figure 9:
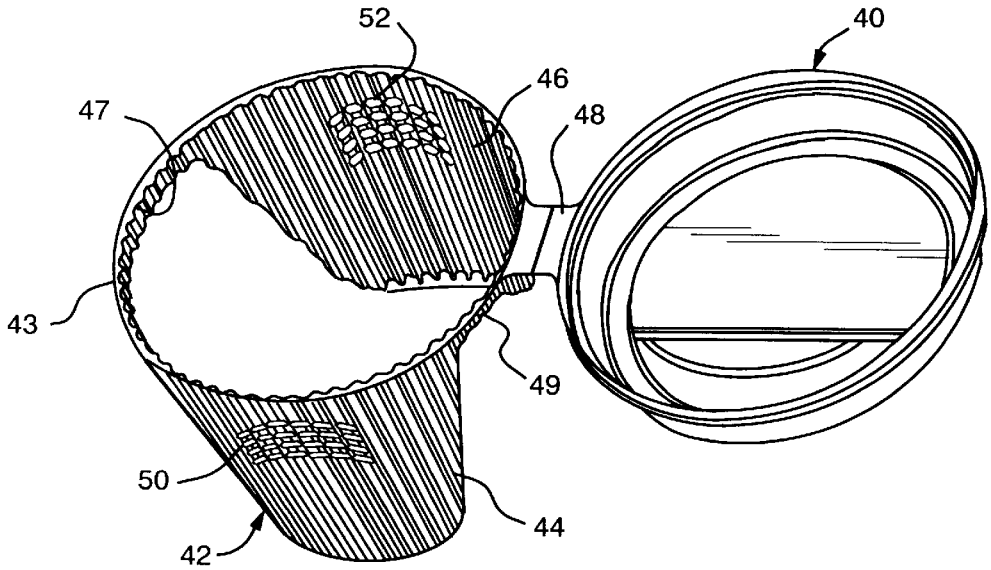
FIG. 9 is a perspective view of an alternate embodiment of the invention showing a lid hinged to a circular ring having protective guards extending downward on opposite sides of the ring.
Figure 10:
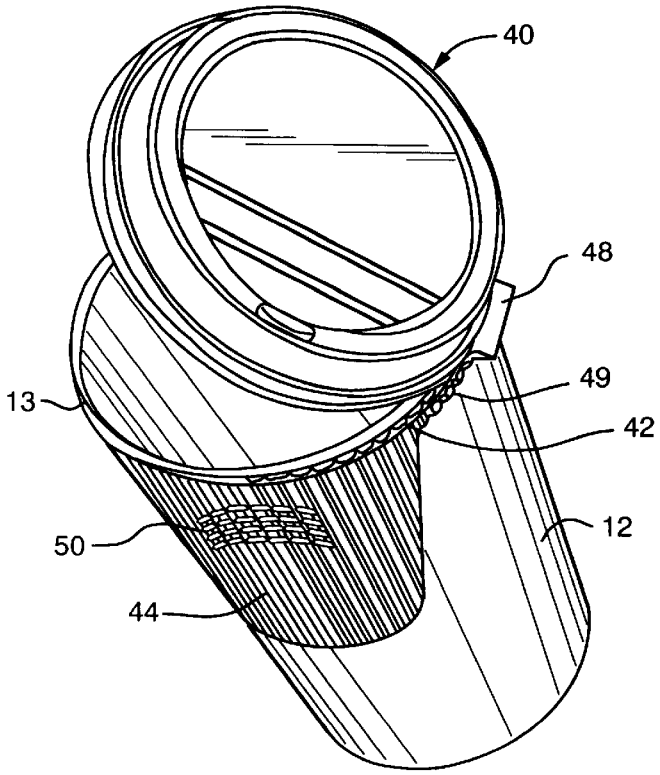
FIG. 10 is a perspective view of a cup inserted in the ring of the alternate embodiment of FIG. 9 with the lid positioned just above the top of the cup.

Referring now to FIG. 9 and FIG. 10, FIG. 9 shows a perspective view of a third embodiment of the invention for protecting the fingers of the user from a hot beverage cup 12. Such embodiment comprises a combination of lid 40 and protective guard 42 connected together by hinge 48. The lid 40 and hinge 48 are the same design and construction as the plastic lid 30 and hinge 36 in FIG. 6. The guard 42 comprises a ring 43 having formed, plastic, downward extensions of predetermined varying lengths. Downward extensions 44, 46, which are positioned opposite each other, provide the thermal protection for fingers, when the cup 12 is placed within the ring 43 and the ring 43 is positioned under the lip 13 of the cup 12 as shown in FIG. 10. The shape of short downward extensions 47, 49 between the long downward extensions 44, 46 primarily provide strength for the ring 42. The downward extensions 44, 46, 47, 49 are constructed with formed plastic. They may be of various designs and shapes for providing thermal protection such as embossed, sculptured or corrugated. Roughened surfaces 50, 52 on the longer downward extensions 44, 46 respectively are the same as roughened surface 16 described in FIG. 3, and when used provide a better grip when grasping the guard 42 to drink a hot beverage from the cup 12.

Figure 12:
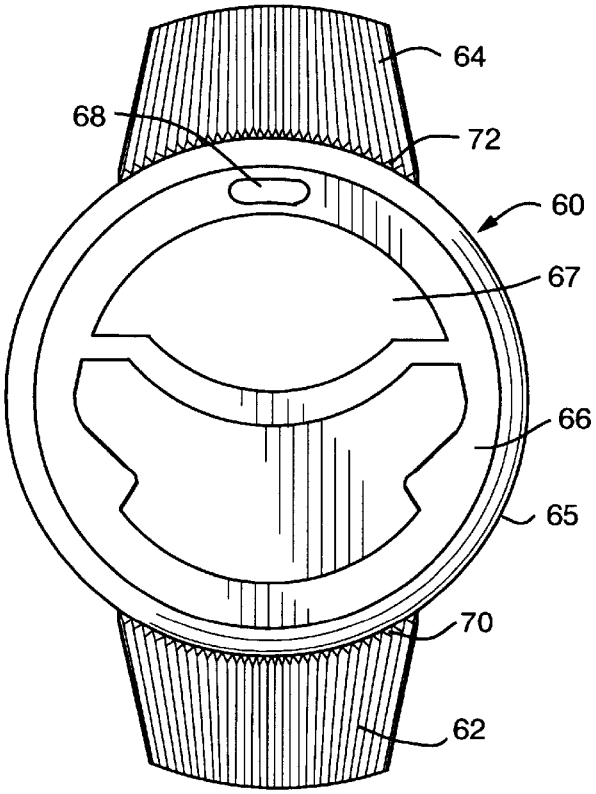
FIG. 12 is a plan view of an alternate embodiment of the invention showing a lid having thermal protective tabs extending from opposite sides of the lid.

Referring now to FIG. 12, a plan view of a fourth alternate embodiment of the invention shows a lid 60 having thermal protection tabs 62, 64 extending from opposite sides of and away from the lid 60. A drinking opening 68 is provided in a top wall 66 of lid 60 to enable drinking from the cup 12 without removal of the lid 60. The lid 60 is centered about the drinking opening 68. The lid comprises a mounting portion 65 for engaging the lip of the cup 12. The tabs 62, 64 extend outward away from the lid 60 a predetermined distance, and flexible hinges 70, 72 are provided at the point where tabs 62, 64 respectively attach to the periphery of lid 60 which permits tabs 62, 64 to be folded downward adjacent to the side of cup 12. The flexible hinges 70, 72 are formed by scoring or by perforating or by other techniques commonly known to one of ordinary skill in the art. The lid 60 is made of formed plastic.

Figure 13:
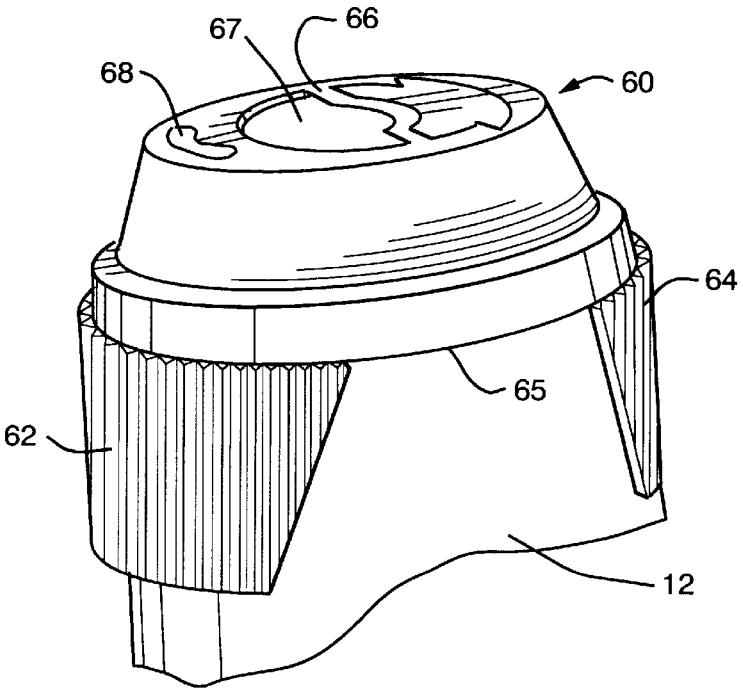
FIG. 13 is a perspective view of the alternate embodiment of FIG. 12 disposed on a beverage cup having the protective tabs folded downward adjacent to the side of the cup.

Referring now to FIG. 13, a perspective view of the alternate embodiment of FIG. 12 disposed on a beverage cup is shown having the protective tabs 62, 64 folded downward resulting in the tabs 62, 64 being adjacent to the side of the cup 12 for providing thermal protection to the fingers of the cup user. The plastic tabs 62, 64 may have an embossed design, parallel rib design or various other designs depending on the designer's choice.

Figure 14:
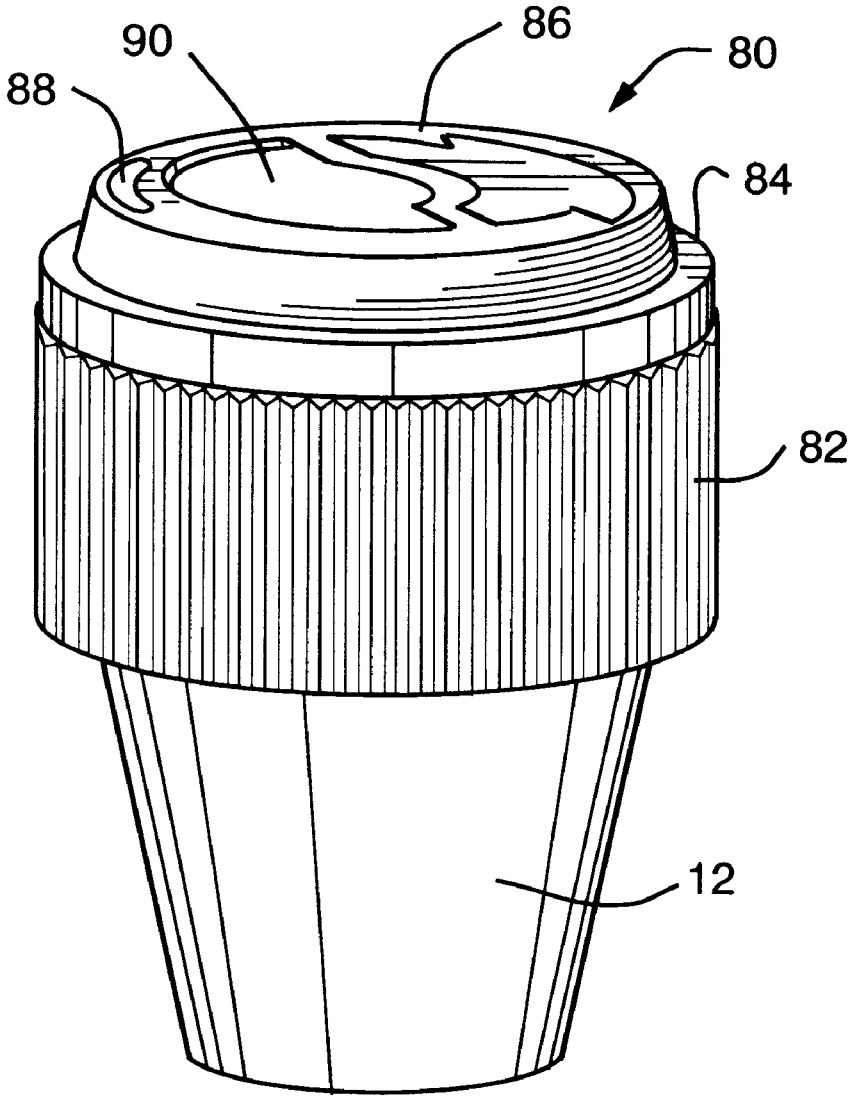
FIG. 14 is a perspective of an alternate embodiment of the invention showing a lid having a cylindrical guard extending downward from the bottom periphery of the lid.

Referring now to FIG. 14, a perspective view of a fifth alternate embodiment of the invention showing a lid 80 having a cylindrical thermal guard 82 extending downward a predetermined distance from the bottom of the periphery of a mounting portion 84 of the lid 80 which engages the lip of the cup 12. A top wall 86 of the lid 80 comprises a drinking opening 88 to enable drinking from the cup 12 without removal of the lid 80, and the thermal guard 80 protects the hand of a user when the cup 12 contains a very hot beverage such as coffee. The lid 80 is also made of formed plastic and the design of the cylindrical guard 82 may be embossed or have various other irregular designs depending on designer's choice as long as there is air between the guard 82 and the hot surface of the cup 12. The height of the cylinder guard 82 may typically be approximately 1.5 inches but this may vary depending on the cup size.

Figure 15:
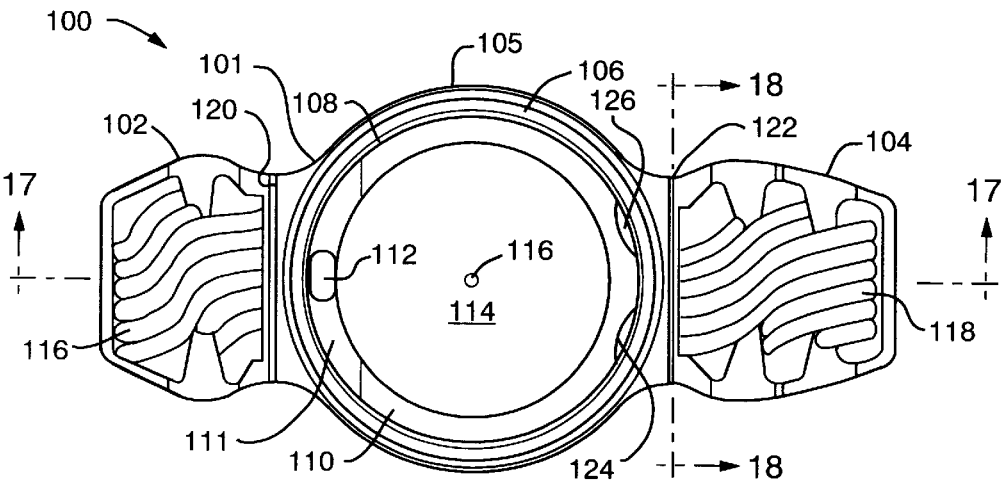
FIG. 15 is a top plan view of an improved embodiment of the invention showing a drinking cup lid having flaps extending from opposite sides of the lid for providing thermal protection.
Figure 20:
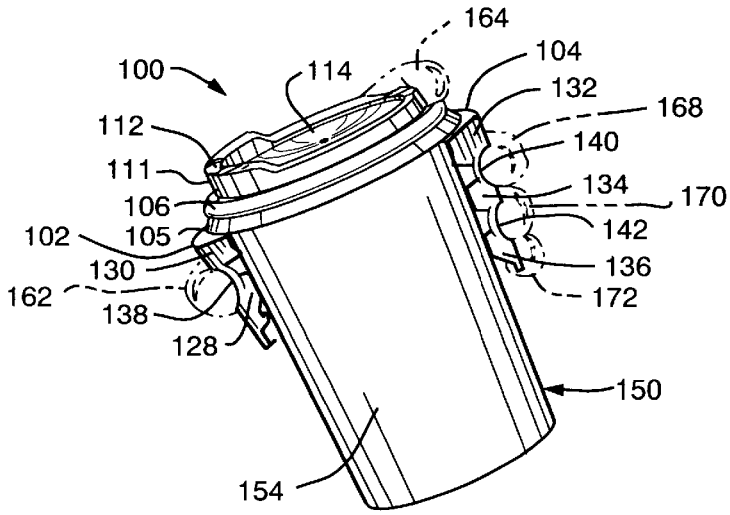
FIG. 20 is a perspective view of the drinking cup lid of FIG. 15 attached to a cup being held by a consumer showing the position of the consumer's fingers on the flaps.

Referring now to FIG. 15 and FIG. 20, FIG. 15 is a plan view of a sixth alternate embodiment of a drinking cup lid 100 comprising a cover 101 having flex-guards or flaps 102, 104 extending from opposite sides. The lid 100 is designed to be detachably secured to an open end rim 152 of a cup 150 (FIG. 20) such as a paper or styrofoam cup. The flex-guards or flaps 102, 104 protect a person's fingers from the heat emanating from the side of the cup 150. The flaps 102, 104 immediately fold down and remain down adjacent to the sidewall 154 of the cup 150 by simply touching and moving the flaps in a downward direction. FIG. 20 is a perspective view of the drinking cup lid 100 attached to the cup 150 being held by a person's hand showing the position of the fingers on the flaps 102, 104. The thumb 162 grasps flap 102 and two or three fingers 168, 170, 172 grasp flap 104. The index finger rests against one of the finger contours 124, 126 depending on whether the cup 150 is held in the left hand or right hand. The cover 101 structure facilitates easily removing the lid 100 from a drinking cup 150 to add other ingredients or add more liquid.

Figure 16:
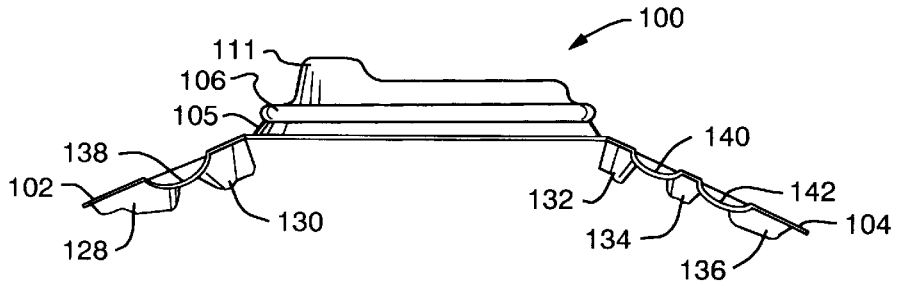
FIG. 16 is a front elevational view of the cup lid of FIG. 15 showing standoff pillars for resting against the side of the cup and finger depressions.

Referring again to FIG. 15 and also FIG. 16, FIG. 16 is a front elevational view of the cup lid 100. The lid 100 comprises a cover portion 101 having an annular channel 106 for sealingly engaging an upper rim 152 of the cup 150. A skirt 105 extends downward briefly from the outer edge of the annular channel 106. The inner wall of the annular channel 106 forms a side of a moat channel 108 which collects liquid spillage. The other side of the moat channel 108 rises above the level of the annular channel 106 forming a circular plateau 110 which is higher at the drinking side of the lid 100, forming a spout 111 having a drinking opening 112, than at the other side of the lid 100. The top 114 of the cover 101 surrounded by the plateau 110 is a concave design having a hole 116 in the middle to allow liquid spillage to return inside the cup 150. A portion of the plateau 110 opposite the drinking hole 112 comprises two adjacent finger contours 124, 126 on the side wall of the plateau 110 for positioning an index finger thereon, when a person grasps the flaps 102, 104 of lid 100 secured on the cup 150.

Still referring to FIG. 15 and FIG. 16, the flaps 102, 104 are connected to the cover 101 by flexible hinges 120, 122 respectively. The hinges 120, 122 are formed by compressing a strip of the material along the edge of the cover 101 where the flaps 102, 104 begin to extend outward. This type of hinge results in the flaps 102, 104 remaining down adjacent to the cup sidewall 154. Flap 104 extends further away from the cover 101 than flap 102. Flap 102 is intended for receiving only the thumb of a person's hand and keeping its length shorter provides an indication of which side of the cover 101 the drinking opening 112 is located on and the shorter flap 102 allows more advertising on the sidewall of cup 150 to be seen. The shorter flap 102 also requires less material. The longer flap 104 has greater surface area because it is intended to receive at least two fingers for secure holding of the cup 150, when the flaps 102, 104 have been pressed down against the sidewall 154 of the cup 150.

Figure 17:
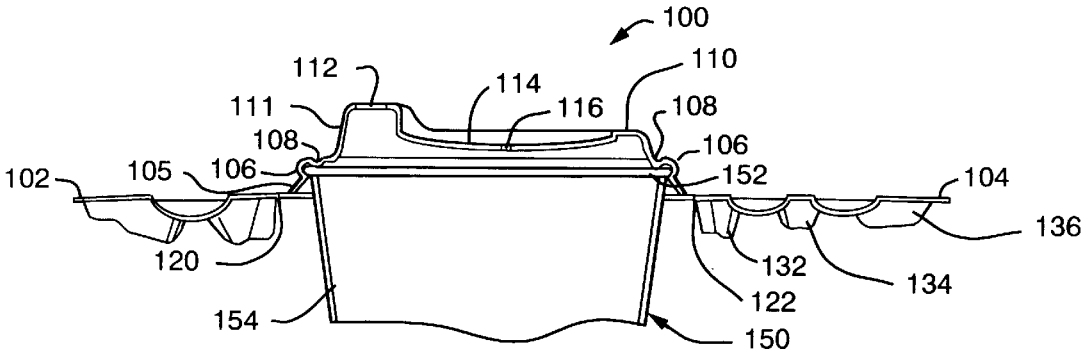
FIG. 17 is a partial cross-sectional view of the cup lid of FIG. 15 taken along plane 17—17 showing the lid attached to a cup.
Figure 18:
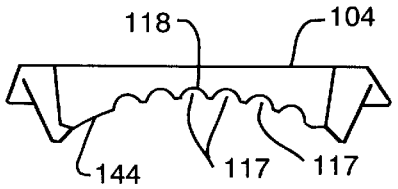
FIG. 18 is a sectional view of the longer flap of the lid taken along plane 18—18 of FIG. 1 showing the concave inner surface of the flap.

Referring to FIGS. 15 to 18, the majority of the surface area of the flaps 102, 104 comprises embossing in the form of vertically oriented swirled ribs or grooves 116, 118 with a convex upper or outer surface which provides for thermal protection of the fingers holding the cup 150. FIG. 18 is a sectional view of the longer flap 104 showing the swirled ribs or grooves 118 and particularly showing the concave contour of the inner surface of flap 104 which conforms to the shape of the sidewall 154 of the cup 150 when positioned in contact with the sidewall 154. Flap 102 has a similar contour. One of ordinary skill in the art will recognize that other embossing designs may be selected to achieve the thermal protection and holding retention feature of the flaps 102, 104. The embossing of the flaps 102, 104 provides for better gripping of the cup and reduces the possibility of pressure being applied back to the cover 101 causing the cover 101 to pop off. The grooves 117 of the swirled ribs 118 minimize heat on the outside surface of the flaps 102, 104 by allowing convective airflow to dissipate heat build-up in the flaps 102, 104. When a person's fingers are removed from the flaps 102, 104, the flaps tend to move slightly away from the sidewall 154 of the cup 150 allowing air to flow around the surfaces of the flaps 102, 104 that were touching the cup 150, thereby providing convection cooling of the flaps 102, 104.

Figure 21:
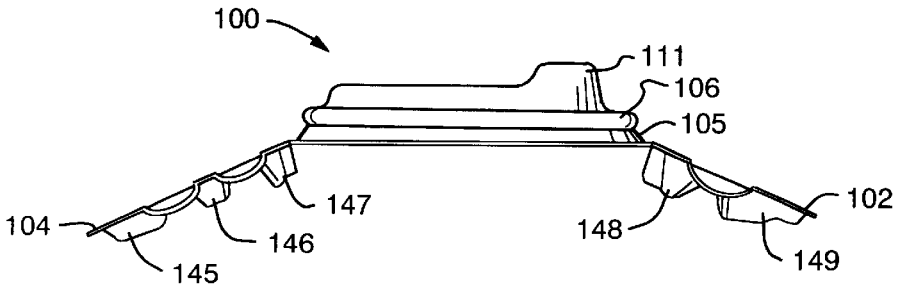
FIG. 21 is a rear elevational view of the cup lid of FIG. 15 showing standoff pillars for resting against the side of the cup and the finger depressions.

Referring again to FIG. 16 and also FIG. 21, in addition to the swirled ribs 118, the flaps 102, 104 comprise standoffs 128, 130 which are provided along the side of flap 102 and contact the cup sidewall 154 as shown in FIG. 20. Flap 104 has similar standoffs 132, 134, 136 along the side. FIG. 21 is a rear elevational view of cup lid 100 showing the standoffs 145, 146, 147, 148, 149 along the side of flaps 102, 104 similar to the standoffs on the opposite side as shown in FIG. 16. The standoffs provide stability when the flaps 102, 104 are pressed against the cup sidewall 154, and they also provide thermal protection for the fingers.

Figure 19:
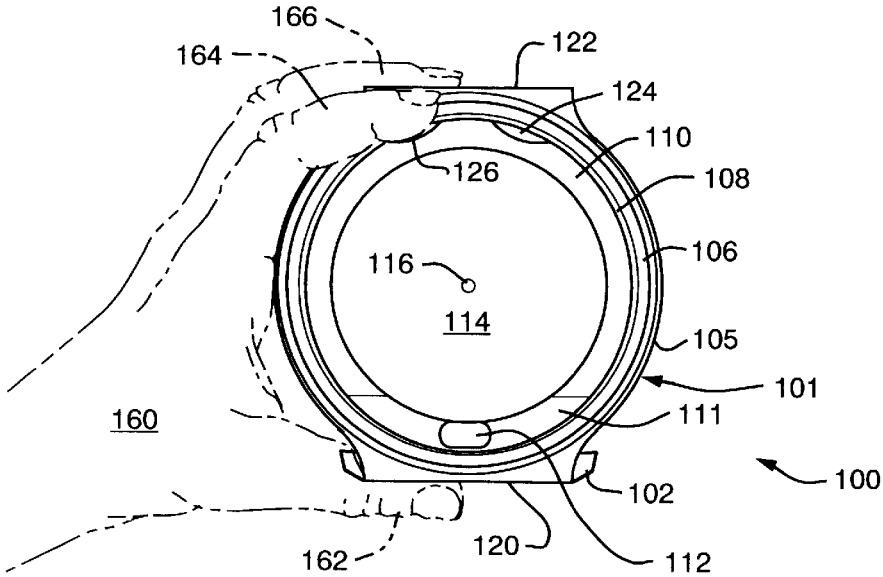
FIG. 19 is a top view of the cup lid having the flaps folded down showing a finger groove for the positioning of an index finger on the side of an upper rim of the lid and positioning of the flap.

Referring now to FIG. 16, FIG. 19 and FIG. 20, grooved or depressed finger grips 138, 140, 142 are provided on opposite edges of flaps 102, 104 for comfortable and secure placement of a person's fingers on the flaps 102, 104 especially when holding a hot cup of coffee. FIGS. 19 and 20 both show a person's hand holding a cup 150 with the lid 100 attached and the fingers gripping the flaps 102, 104. In particular, the index finger 164 is positioned within the finger depression or contour 126 along the side of the plateau 110 portion of the cover 101.

Referring now to FIG. 17, a cross-sectional view is shown of the cup lid 100 attached to the cup 150. The annular plateau 110 rises on the drinking opening 112 side to a plateau forming a pedestal or spout 111 for ease of drinking from the opening 112. The concave surface of the top 114 of the cover is shown and the hole 116 in the center allows the liquid to reenter the cup 150. The rim 152 of the cup 150 is shown engaged within the annular channel 106 for sealing the lid 100 on the cup 150.

Referring again to FIG. 19 and FIG. 20, FIG. 19 shows a top view of the method of holding a cup 150 with the flaps 102, 104 down against the sidewall of the cup 150 and FIG. 20 provides a perspective view and shows the tips of the fingers 162, 168, 170 resting in the finger grips 138, 140, 142 respectively on opposite edges of flaps 102, 104. These finger grips 138, 140, 142 provide comfortable and secure placement of a person's finger on flaps 102, 104. The concave top 114 of lid cover 101 is surrounded by the circular plateau 110 which rises above the plane of the concave top 114. The diameter of the concave top 114 is sufficient to receive the bottom of another cup 150 thereby enabling the stacking of cups 150.

The cup lid 100 may be fabricated from a thermoplastic material and formed into the desired configuration as shown in FIGS. 15–20 by thermoforming or injection molding. Commonly known thermoplastic materials which may be used include polypropylene and high impact polystyrene. Such materials provide the advantages of high strength, ease of fabrication, desirable mechanical properties, and low cost.

This invention has been disclosed in terms of certain embodiments. It will be apparent that many modifications can be made to the disclosed apparatus without departing from the invention. For example, the lid 100 with the thermal flex-guards 102, 104 may be of various sizes to match different size cups. Further, the amount of surface area that is covered around the side wall 154 of the cup 150 is based on the designer's choice. Therefore, it is the intent of the appended claims to cover all such variations and modifications as come within the true spirit and scope of this invention.

What is claimed as new and desired to be secured by Letters Patent of the United States is:

1. In combination:

a lid comprising a cover for sealingly engaging an upper rim of a drinking cup;

said cover comprises a circular plateau having a raised portion with a drinking opening;

means for thermal protection of fingers of a cup holder, said thermal protection means extending from portions of opposite sides of said cover of said lid, wherein a first one of said thermal protection means adjacent to said drinking opening is shorter than a second one of said thermal protection means on said opposite side of said cover;

means positioned between said cover and said thermal protection means for folding down said thermal protection means to be positioned adjacent to a sidewall of said cup; and said thermal protection means comprises a contour conforming to a sidewall of said cup.

2. The combination as recited in claim 1 wherein said folding down means comprises a strip of compressed material.

3. The combination as recited in claim 1 wherein said raised portion of said circular plateau having said drinking opening on a top surface is positioned above said first one of said thermal protection means when said thermal protection means are folded down.

4. The combination as recited in claim 1 wherein said thermal protection means comprises a plurality of standoffs extending from a surface closest to said sidewall for contact with said sidewall of said cup.

5. The combination as recited in claim 1 wherein said cover comprises a moat channel around a periphery of an upper portion of said cover for collecting liquid spillage.

6. The combination as recited in claim 1 wherein a top concave surface surrounded by said circular plateau of said cover comprises a hole in the center for returning liquid spillage to said cup.

7. The combination as recited in claim 1 wherein said thermal protection means comprises embossing for facilitating cup retention when grasped by fingers of said cup holder.

8. The combination as recited in claim 7 wherein said embossing comprises vertically oriented swirled ribs.

9. A lid for a drinking cup comprising:

a cover for sealingly engaging and disengaging an upper rim of said drinking cup;

a drinking opening positioned on a raised portion of a circular plateau on top of said cover, said circular plateau comprises a recessed area along a side of said plateau opposite said drinking opening for accommodating a finger of a cup holder;

a first flap extending a first distance from a first portion of said cover adjacent to said drinking opening for providing thermal protection;

a second flap extending a second distance from an opposite portion of said cover for providing thermal protection;

first flexible hinge means between said first flap and said first portion of said cover and second flexible hinge means between said second flap and said opposite portion of said cover for enabling said first flap and said second flap to be folded down and remain down adjacent to a sidewall of said drinking cup.

10. The lid as recited in claim 9 wherein each of said first flap and said second flap comprises a contour conforming to said sidewall of said cup.

11. The lid as recited in claim 9 wherein each of said first flap and said second flap comprises embossing including swirled ribs to provide thermal protection to a cup holder's fingers.

12. The lid as recited in claim 9 wherein each of said first flap and said second flap comprises a plurality of standoffs extending from the surface of said first flap and said second flap closest to said sidewall to provide said thermal protection to a cup holder's fingers.

13. The lid as recited in claim 9 wherein each of said first flexible hinge and said second flexible hinge comprises a strip of compressed material for enabling said first flap and said second flap to remain folded down adjacent to said sidewall of said drinking cup.

14. The lid as recited in claim 9 wherein said lid comprises a high impact polystyrene plastic.

15. The lid as recited in claim 9 wherein said lid comprises a polypropylene plastic.

16. The lid as recited in claim 9 wherein said cover comprises a moat channel formed between a side wall of said circular plateau and an outer surface of a channel for sealingly engaging an upper rim of said drinking cup, said moat channel collecting liquid spillage.

17. The lid as recited in claim 9 wherein said lid enables a cup holder to identify a side of said cover having said drinking opening by means of a shorter length of said first flap positioned under said drinking opening when said lid is engaged to said cup.

18. The lid as recited in claim 9 wherein each of said first flap and said second flap comprises a depression along outer side edges for providing comfortable and secure placement of a person's fingers.

19. The lid as recited in claim 9 wherein each of said first flap and said second flap comprises an embossing to provide increased cup retention when grasped by fingers of a cup holder.

20. The lid as recited in claim 19 wherein said embossing comprises vertically oriented swirled ribs.

21. The lid as recited in claim 9 wherein said circular plateau encircles a concave top portion of said cover having a hole in the center thereby allowing liquid spillage to reenter said cup.

22. The lid as recited in claim wherein said concave top portion of said cover, surrounded by said circular plateau, comprises a diameter sufficient to receive a bottom portion of a drinking cup, thereby facilitating stacking of cups.

23. A method of providing a lid for a drinking cup comprising the steps of:

providing a cover for sealingly engaging an upper rim of said drinking cup;

providing on said cover a circular plateau having a raised portion with a drinking opening;

protecting fingers of a cup holder with thermal protecting means extending from portions of opposite sides of said cover of said lid;

providing a first one of said thermal protecting means adjacent to said drinking opening to be shorter than a second one of said thermal protecting means on an opposite side of said cover;

folding down said thermal protecting means to be positioned adjacent to a sidewall of said cup with means positioned between said cover and said thermal protecting means; and providing said thermal protecting means with a contour conforming to a sidewall of said cup.

24. The method as recited in claim 23 wherein said step of folding down said thermal protecting means comprises the step of providing a strip of compressed material between said cover and said thermal protecting means.

25. The method as recited in claim 23 wherein said method comprises the step of providing said raised portion having said drinking opening of said circular plateau above said first one of said thermal protecting means when said thermal protecting means are folded down.

26. The method as recited in claim 23 wherein said step of providing thermal protecting means comprises the step of providing a plurality of standoffs extending from a surface of said thermal protecting means closest to said sidewall for contact with said sidewall of said cup.

27. The method as recited in claim 23 wherein said method comprises the step of providing a moat channel around a periphery of an upper portion of said cover for collecting liquid spillage.

28. The method as recited in claim 23 wherein said method comprises the step of providing a top concave surface surrounded by said circular plateau of said cover with a hole in the center for returning liquid spillage to said cup.

29. The method as recited in claim 23 wherein said method comprises the step of providing said thermal protecting means with embossing for facilitating cup retention when grasped by fingers of said cup holder.

30. The method as recited in claim 29 wherein said step of embossing said thermal protecting means comprises the step of providing vertically oriented swirled ribs.

31. A method of providing a lid for a drinking cup comprising the steps of:

providing a cover for sealingly engaging and disengaging an upper rim of said drinking cup;

positioning a drinking opening on a raised portion of a circular plateau on top of said cover;

providing on a side of said circular plateau a recessed area opposite said drinking opening for accommodating a finger of a cup holder;

extending a first flap a first distance from a first portion of said cover adjacent to said drinking opening for providing thermal protection;

extending a second flap a second distance from an opposite portion of said cover for providing thermal protection; and providing first flexible hinge means between said first flap and said first portion of said cover and second flexible hinge means between said second flap and said opposite portion of said cover for folding down said first flap and said second flap and remaining down adjacent to a sidewall of said drinking cup.

32. The method as recited in claim 31 wherein said method comprises the step of providing said first flap and said second flap with a contour conforming to said sidewall of said cup.

33. The method as recited in claim 31 wherein said method comprises the step of providing said first flap and said second flap with a plurality of standoffs extending from the surface of said first flap and said second flap closest to said sidewall to provide thermal protection to a cup holder's fingers.

34. The method as recited in claim 31 wherein said step of providing said first flexible hinge and said second flexible hinge further comprises the step of providing a strip of compressed material for enabling said first flap and said second flap to remain folded down adjacent to said sidewall of said drinking cup.

35. The method as recited in claim 31 wherein said method comprises the step of making said lid with a high impact polystyrene plastic.

36. The method as recited in claim 31 wherein said method comprises the step of providing a moat channel on top of said cover formed between a side wall of said circular plateau and an outer surface of a channel for sealingly engaging an upper rim of said drinking cup, said moat channel collecting liquid spillage.

37. The method as recited in claim 31 wherein said method comprises the step of enabling a cup holder to identify the drinking opening side of said cover by means of said first flap being shorter and being positioned under said drinking opening when said lid is engaged to said cup.

38. The method as recited in claim 31 wherein said method comprises the step of providing a depression along opposite edges of each of said first flap and said second flap for providing comfortable and secure placement of a person's fingers.

39. The method as recited in claim 31 wherein said method comprises the step of providing embossing on said first flap and said second flap to provide increased cup retention when grasped by fingers of a cup holder.

40. The method as recited in claim 39 wherein said step of providing embossing on said first flay and said second flap comprises the step of providing vertically oriented swirled ribs.

41. The method as recited in claim 31 wherein said method comprises the step of providing a concave top portion of said cover surrounded by said circular plateau having a hole in the center, thereby allowing liquid spillage to reenter said cup.

42. The method as recited in claim 41 wherein said method comprises the step of providing said concave top portion of said cover, surrounded by said circular plateau, with a diameter sufficient to receive a bottom portion of a drinking cup, thereby facilitating smacking of cars.

* * * * *